US009605484B2

(12) United States Patent
Gillis et al.

(10) Patent No.: US 9,605,484 B2
(45) Date of Patent: Mar. 28, 2017

(54) DRILLING APPARATUS AND METHOD

(71) Applicant: Drilformance Technologies, LLC, Houston, TX (US)

(72) Inventors: Sean Gillis, Beaumont (CA); Matt Mangan, Edmonton (CA)

(73) Assignee: DRILFORMANCE TECHNOLOGIES, LLC, Houston, TX (US)

( * ) Notice: Subject to any disclaimer, the term of this patent is extended or adjusted under 35 U.S.C. 154(b) by 257 days.

(21) Appl. No.: 14/194,710

(22) Filed: Mar. 1, 2014

(65) Prior Publication Data

US 2014/0246234 A1 Sep. 4, 2014

Related U.S. Application Data

(60) Provisional application No. 61/772,412, filed on Mar. 4, 2013.

(51) Int. Cl.

| | |
|---|---|
| ***E21B 7/24*** | (2006.01) |
| ***E21B 44/00*** | (2006.01) |
| ***E21B 10/08*** | (2006.01) |

(52) U.S. Cl.

CPC ..... *E21B 7/24* (2013.01); *E21B 10/083* (2013.01); *E21B 44/00* (2013.01)

(58) Field of Classification Search

CPC . E21B 7/24; E21B 10/083; E21B 4/16; E21B 4/14; E21B 28/00

See application file for complete search history.

(56) References Cited

U.S. PATENT DOCUMENTS

| | | | | |
|---|---|---|---|---|
| 2,554,005 | A | 5/1951 | Bodine | |
| 2,717,763 | A | 9/1955 | Bodine | |
| 2,942,849 | A | 6/1960 | Bodine | |
| 3,096,833 | A | 7/1963 | Bodine | |
| 3,139,146 | A | 6/1964 | Bodine | |
| 3,163,240 | A | 12/1964 | Bodine | |
| 3,211,243 | A | 10/1965 | Bodine | |
| 3,464,505 | A * | 9/1969 | Vincent | E21B 4/14 173/137 |

(Continued)

FOREIGN PATENT DOCUMENTS

CA WO2012083413 9/2011

OTHER PUBLICATIONS

"What is Fluid Technology", Bowles Fluidics Corporation, http://www.bowlesfluidics.com/capabilities/technology, dated Feb. 19, 2013 (2 pages).

*Primary Examiner* — Jennifer H Gay

(74) *Attorney, Agent, or Firm* — Terrence N. Kuharchuk; Rodman & Rodman

(57) ABSTRACT

A drilling apparatus including a drill bit and a nutation device. The drilling apparatus is configured to enable the drill bit to be rotated at a rotation frequency while the nutation device simultaneously nutates the drill bit at a nutation frequency. The nutation device may include a vibrating device for imposing vibrations upon the drilling apparatus at a vibration frequency, thereby causing nutation of the drill bit at the nutation frequency. The drilling apparatus may include a tuning mechanism for tuning the vibration frequency of the vibrating device. A method including rotating a drill bit at a rotation frequency and simultaneously nutating the drill bit at a nutation frequency.

36 Claims, 13 Drawing Sheets

(56) References Cited

U.S. PATENT DOCUMENTS 3,491,838 A * 1/1970 Wilder ..... E21B 4/14 173/73
3,633,688 A 1/1972 Bodine
3,768,576 A * 10/1973 Martini ..... E21B 7/24 173/136
3,807,512 A * 4/1974 Pogonowski ..... E21B 6/00 175/106
4,096,762 A 6/1978 Bodine
4,168,755 A * 9/1979 Willis ..... E21B 10/04 175/215
4,261,425 A 4/1981 Bodine
4,266,619 A 5/1981 Bodine
4,271,915 A 6/1981 Bodine
4,502,552 A * 3/1985 Martini ..... E21B 7/24 175/321
4,512,417 A * 4/1985 Kurt ..... B25D 9/06 173/102
4,630,689 A * 12/1986 Galle ..... E21B 7/24 137/804
4,693,326 A * 9/1987 Bodine ..... E21B 4/006 175/107
4,819,745 A * 4/1989 Walter ..... E21B 7/18 175/107
4,830,122 A * 5/1989 Walter ..... E21B 7/18 175/106
4,852,669 A * 8/1989 Walker ..... E21B 4/02 175/107
4,905,909 A 3/1990 Woods
4,979,577 A * 12/1990 Walter ..... E21B 7/18 175/243
5,165,438 A 11/1992 Facteau et al.
5,893,383 A 4/1999 Facteau
5,957,220 A * 9/1999 Coffman ..... E21B 4/00 173/73
6,009,948 A 1/2000 Flanders et al.
6,047,778 A * 4/2000 Coffman ..... E21B 4/00 173/205
6,279,670 B1 8/2001 Eddison et al.
6,289,998 B1 * 9/2001 Krueger ..... E21B 7/18 175/107
6,338,390 B1 * 1/2002 Tibbitts ..... E21B 7/24 175/381
6,561,290 B2 5/2003 Blair et al.
7,182,407 B1 * 2/2007 Peach ..... E21C 25/16 299/75
7,591,327 B2 * 9/2009 Hall ..... E21B 4/06 175/389
7,730,970 B2 6/2010 Fincher et al.
8,528,649 B2 * 9/2013 Kolle ..... E21B 21/10 166/321
9,068,400 B2 * 6/2015 Wiercigroch ..... E21B 4/12
9,200,494 B2 * 12/2015 Bakken ..... E21B 31/005
2005/0121231 A1 * 6/2005 Clayton ..... E21B 31/005 175/55
2005/0178558 A1 * 8/2005 Kolle ..... E21B 47/14 166/373
2007/0221408 A1 * 9/2007 Hall ..... E21B 4/06 175/57
2010/0224412 A1 * 9/2010 Allahar ..... E21B 7/24 175/55
2012/0048619 A1 3/2012 Seutter et al.
2012/0132289 A1 * 5/2012 Koll ..... E21B 21/10 137/14
2012/0160476 A1 6/2012 Bakken
2012/0241219 A1 * 9/2012 Wiercigroch ..... E21B 4/12 175/56
2013/0277116 A1 * 10/2013 Knull ..... E21B 4/003 175/57
2014/0041943 A1 * 2/2014 Lanning ..... E21B 4/02 175/57
2014/0246234 A1 * 9/2014 Gillis ..... E21B 7/24 175/24

* cited by examiner

DRILLING APPARATUS AND METHOD

TECHNICAL FIELD

A drilling apparatus and method in which a drill bit is simultaneously rotated at a rotation frequency and nutated at a nutation frequency. An apparatus and method in which a vibration frequency of a vibrating device is cyclically varied between a lower frequency limit and an upper frequency limit in order to nutate a drill bit at a nutation frequency.

BACKGROUND OF THE INVENTION

During the drilling of underground wells it is common to utilize downhole motors, particularly if the wellbore needs to be directionally drilled. Downhole motors are very well known, an example of the prior art can be found in U.S. Pat. No. 6,561,290.

Albert Bodine is the patentee of a number of patents related to the technology of downhole cycloidal drill bits (U.S. Pat. No. 4,266,619), mechanically nutating drills (U.S. Pat. No. 4,261,425) and elastically vibrating drills (U.S. Pat. No. 4,271,915). None of these patents contemplate rotation of the drill bit with a drilling motor simultaneously with nutation of the drill bit.

The application of vibratory forces such as oscillations to a pipe string in a wellbore may be used to reduce frictional forces that impede the progression of the pipe string through the wellbore. Various types of vibratory forces have been contemplated for this purpose. For example, the vibratory forces may be longitudinal, transverse or torsional in nature (or perhaps a combination of different forces). Non-limiting examples of devices which generate transverse vibratory forces to reduce frictional forces are described in U.S. Patent Application Publication No. 2012/0160476 (Bakken) and/or PCT International Publication No. WO 2012/083413 A1 (Bakken).

In U.S. Pat. No. 6,279,670 (Eddison et al), drive means such as a positive displacement motor are used to rotate a first member of a valve relative to a second member of a valve in order to vary the flow rate of fluid through a pressure responsive device such as a shock tool, thereby varying a vibration frequency of the pressure responsive device, on the basis that the vibration frequency is generally proportional to the flow rate.

In both U.S. Pat. No. 6,009,948 (Flanders et al) and U.S. Patent Application Publication No. 2012/0048619 (Seutter et al), the vibration frequency of a "resonance tool" and a "drilling agitator tool" respectively are adjusted to achieve a resonant frequency of the system, based upon feedback from downhole sensors which measure the tool responses downhole. In both cases, the vibration frequency is adjusted incrementally until an acceptable excitation level of the pipe string is obtained.

In U.S. Pat. No. 7,730,970 (Fincher et al), controlled oscillations are superimposed on steady drill bit rotation in order to maintain a selected rock fracture level as stress energy stored in an earthen formation is released when fracture of the rock is initiated. In some embodiments of Fincher et al, a control unit performs a frequency sweep to determine an oscillation that optimizes the cutting action of the drill bit and configures the oscillation apparatus accordingly.

There are disadvantages to all of the above approaches. Eddison et al does not allow for changes to be made to the vibration frequency of the pressure responsive device without changing the fluid flow rate through the pipe string.

Flanders et al, Seutter et al and Fincher et al all rely on potentially complex sensors and electronic control systems which may be prone to failure in the wellbore environment.

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

References in this document to "proximal", "uphole" or "upper", and "distal", "downhole" or "lower" refer to position relative to the ground surface or the end of a borehole, with the ground surface being relatively proximal, uphole and upper and the end of the borehole being relatively distal, downhole and lower.

As used herein, "precession" is a change in the orientation of a rotational axis of a rotating body. As used herein, "nutation" is a rocking, swaying or nodding motion in the axis of rotation of a rotating body. As used herein, "precession" and "nutation" are related phenomena, so that references herein to "precession" and "nutation" of a drill bit both describe a rocking, swaying or nodding motion of the drill bit caused by a change in the orientation of the axis of rotation of the drill bit, wherein the rocking, swaying or nodding motion of the drill bit results in a periodic loading and unloading of cutting elements in the cutting face of the drill bit.

The present invention is directed at providing rotation of a drill bit simultaneously with nutation of the drill bit.

In some apparatus embodiments, the present invention is directed at a drilling apparatus comprising a drill bit, wherein the drill bit simultaneously is rotated about a drill bit axis at a rotation frequency and is nutated at a nutation frequency.

In some apparatus embodiments, the present invention is directed at a system comprising a drilling apparatus and a pipe string, wherein the drill bit simultaneously is rotated about a drill bit axis at a rotation frequency and is nutated at a nutation frequency.

The present invention is also directed at a drilling method wherein a drill bit simultaneously is rotated about a drill bit axis at a rotation frequency and is nutated at a nutation frequency. In some method embodiments, the rotation frequency may be greater than the nutation frequency so that the drill bit is rotated more quickly than it is nutated.

In some embodiments, the drilling apparatus may be connected with a pipe string and the drill bit may be rotated at the rotation frequency by rotating the pipe string.

In some embodiments, the drilling apparatus may be comprised of a power source for rotating the drill bit. In some embodiments, the power source may be comprised of a downhole drilling motor. The downhole drilling motor may be comprised of any structure, device or apparatus which is capable of rotating the drill bit. In some embodiments, the drilling motor may be comprised of a positive displacement motor (PDM), such as a Moineau type motor. In such embodiments, the drill bit may be rotated by the power source and/or by rotation of the pipe string.

The drilling apparatus is comprised of a nutation device for nutating the drill bit. The nutation device may be comprised of any structure, device or apparatus which is capable of nutating the drill bit. As non-limiting examples, the drill bit may be nutated by employing a linkage (such as a universal joint) to pivot the drill bit axis relative to the longitudinal axis of the drilling apparatus, and/or the drill bit may be nutated by applying a transverse force to the drilling apparatus in order to cause a tilting of the bit axis relative to the longitudinal axis of the drilling apparatus.

In some embodiments, the nutation device may be comprised of a vibrating device for imposing vibrations upon the drilling apparatus at a vibration frequency, thereby causing nutation of the drill bit at the nutation frequency.

In some embodiments, the vibration frequency may be the same frequency as the nutation frequency. In some embodiments, the vibration frequency may be a different frequency than the nutation frequency.

In some embodiments, the drilling apparatus may be comprised of a tuning mechanism for tuning the vibration frequency of the vibrating device. The tuning mechanism may be actuated automatically, semi-automatically, or manually. As a non-limiting example, in some embodiments, the tuning mechanism may be actuated automatically based upon data provided by sensors. As a non-limiting example, in some embodiments, the tuning mechanism may be actuated semi-automatically based upon data provided by sensors as interpreted by an operator. As a non-limiting example, the tuning mechanism may be actuated manually by an operator.

In some embodiments of the second aspect, the vibrating device may be actuated to sweep through a vibration frequency range which extends between a lower frequency limit and an upper frequency limit. In some embodiments, a desired vibration frequency may be included within the vibration frequency range. In some embodiments, the desired vibration frequency may be a resonant mode frequency. In some embodiments, the vibration frequency range may be "swept" in a cyclical manner.

In some embodiments, the drilling apparatus may be comprised of a tuning mechanism for tuning the vibration frequency range of the vibrating device. The tuning mechanism may be actuated automatically, semi-automatically, or manually. As a non-limiting example, in some embodiments, the tuning mechanism may be actuated automatically based upon data provided by sensors. As a non-limiting example, in some embodiments, the tuning mechanism may be actuated semi-automatically based upon data provided by sensors as interpreted by an operator. As a non-limiting example, the tuning mechanism may be actuated manually by an operator.

In some embodiments, the nutation device may be comprised of a vibrating device such as those described in U.S. Pat. No. 4,261,425 (Bodine), U.S. Pat. No. 4,266,619 (Bodine) and/or U.S. Pat. No. 4,271,915 (Bodine). In some embodiments, the nutation device may be comprised of a vibrating device such as those described in U.S. Patent Application Publication No. 2012/0160476 (Bakken) and/or PCT International Publication No. WO 2012/083413 A1 (Bakken).

In some particular embodiments, the vibrating device may be comprised of a "mass oscillator" which may be comprised of an eccentric mass which is rotated in order to impose vibrations upon the drilling apparatus, wherein the vibrations cause nutation of the drill bit at the nutation frequency.

In some particular exemplary embodiments, the drilling apparatus of the invention may be comprised of a mass oscillator for nutating the drill bit and a positive displacement drilling motor for rotating the drill bit, in order to provide a drilling apparatus that enables rotation and steering of the drill bit while imposing a mechanical nutating action at the drill bit/formation interface. The mass oscillator may also provide other benefits to the operation of the drilling motor.

In some particular embodiments, the drilling apparatus may be incorporated into a downhole drilling assembly. In some embodiments, the downhole drilling assembly may be comprised of the drilling apparatus and one or more additional components in order to achieve a desired drilling configuration. As non-limiting examples, the one or more additional components may be comprised of one or more drill collars, a rotary steerable tool, one or more stabilizers, one or more kickpads, one or more reamers etc. In some embodiments, a desired drilling configuration may be designed to provide a desired vibration resonant mode frequency for the drilling apparatus and/or the drilling assembly.

In some embodiments, the method of the invention may comprise simultaneously rotating a drill bit at a rotation frequency and operating a nutation device in order to nutate the drill bit at a nutation frequency.

In some particular embodiments, the method of the invention may comprise rotating the drill bit at the rotation frequency with a downhole drilling motor.

In some particular embodiments, the method of the invention may comprise actuating a vibrating device in order to impose vibrations upon a drilling apparatus at a vibration frequency, thereby causing nutation of the drill bit at the nutation frequency.

In some embodiments, the vibration frequency may be the same frequency as the nutation frequency. In some embodiments, the vibration frequency may be a different frequency than the nutation frequency.

In some embodiments, the method of the invention may be further comprised of tuning the vibration frequency of the vibrating device. The vibration frequency of the vibrating device may be tuned automatically, semi-automatically, or manually. As a non-limiting example, in some embodiments, the vibration frequency may be tuned automatically based upon data provided by sensors. As a non-limiting example, in some embodiments, the vibration frequency may be tuned semi-automatically based upon data provided by sensors as interpreted by an operator. As a non-limiting example, the vibration frequency may be tuned manually by an operator.

In some embodiments of the second aspect, the vibrating device may be actuated to sweep through a vibration frequency range which extends between a lower frequency limit and an upper frequency limit. In some embodiments, a desired vibration frequency may be included within the vibration frequency range. In some embodiments, the desired vibration frequency may be a resonant mode frequency. In some embodiments, the vibration frequency range may be "swept" in a cyclical manner.

In some embodiments, the method of the invention may be further comprised of tuning the vibration frequency range of the vibrating device. The vibration frequency range of the vibrating device may be tuned automatically, semi-automatically, or manually. As a non-limiting example, in some embodiments, the vibration frequency range may be tuned automatically based upon data provided by sensors. As a non-limiting example, in some embodiments, the vibration frequency range may be tuned semi-automatically based upon data provided by sensors as interpreted by an operator. As a non-limiting example, the vibration frequency range may be tuned manually by an operator.

In some particular embodiments, the vibrating device may be comprised of a "mass oscillator" which may be comprised of an eccentric mass which is oscillated in order to impose vibrations upon the drilling apparatus, wherein the vibrations cause nutation of the drill bit at the nutation frequency.

In some embodiments of the first aspect, the present invention may be directed at a system and a method for imposing vibration on a pipe string at a desired vibration frequency of the system. In some such embodiments, the desired vibration frequency of the system may be a resonant mode frequency of the system. In such embodiments, the vibration may be used to provide nutation of the drill bit, vibration of the pipe string to minimize friction, or for some other purpose.

In some embodiments of the second aspect, the present invention may be directed at a system and a method for imposing vibration on a pipe string at a desired vibration frequency of the system, while allowing for fluctuations in the desired vibration frequency of the system. In some such embodiments, the desired vibration frequency of the system may be a resonant mode frequency of the system. In such embodiments, the vibration may be used to provide nutation of the drill bit, vibration of the pipe string to minimize friction, or for some other purpose.

In some embodiments of both the first aspect and the second aspect, the vibrations applied to a pipe string may be longitudinal vibrations which cause the pipe string to vibrate at a longitudinal vibration frequency. In some embodiments of both the first aspect and the second aspect, the vibrations applied to a pipe string may be transverse vibrations which cause the pipe string to vibrate at a transverse vibration frequency. In some embodiments of both the first aspect and the second aspect, the vibrations applied to a pipe string may be torsional vibrations which cause the pipe string to vibrate at a torsional vibration frequency. In some embodiments of both the first aspect and the second aspect, the vibrations applied to a pipe string may be a combination of longitudinal vibrations, transverse vibrations and/or torsional vibrations.

BRIEF DESCRIPTION OF DRAWINGS

Embodiments of the invention will now be described with reference to the accompanying drawings, in which.

DETAILED DESCRIPTION

Figure 1:
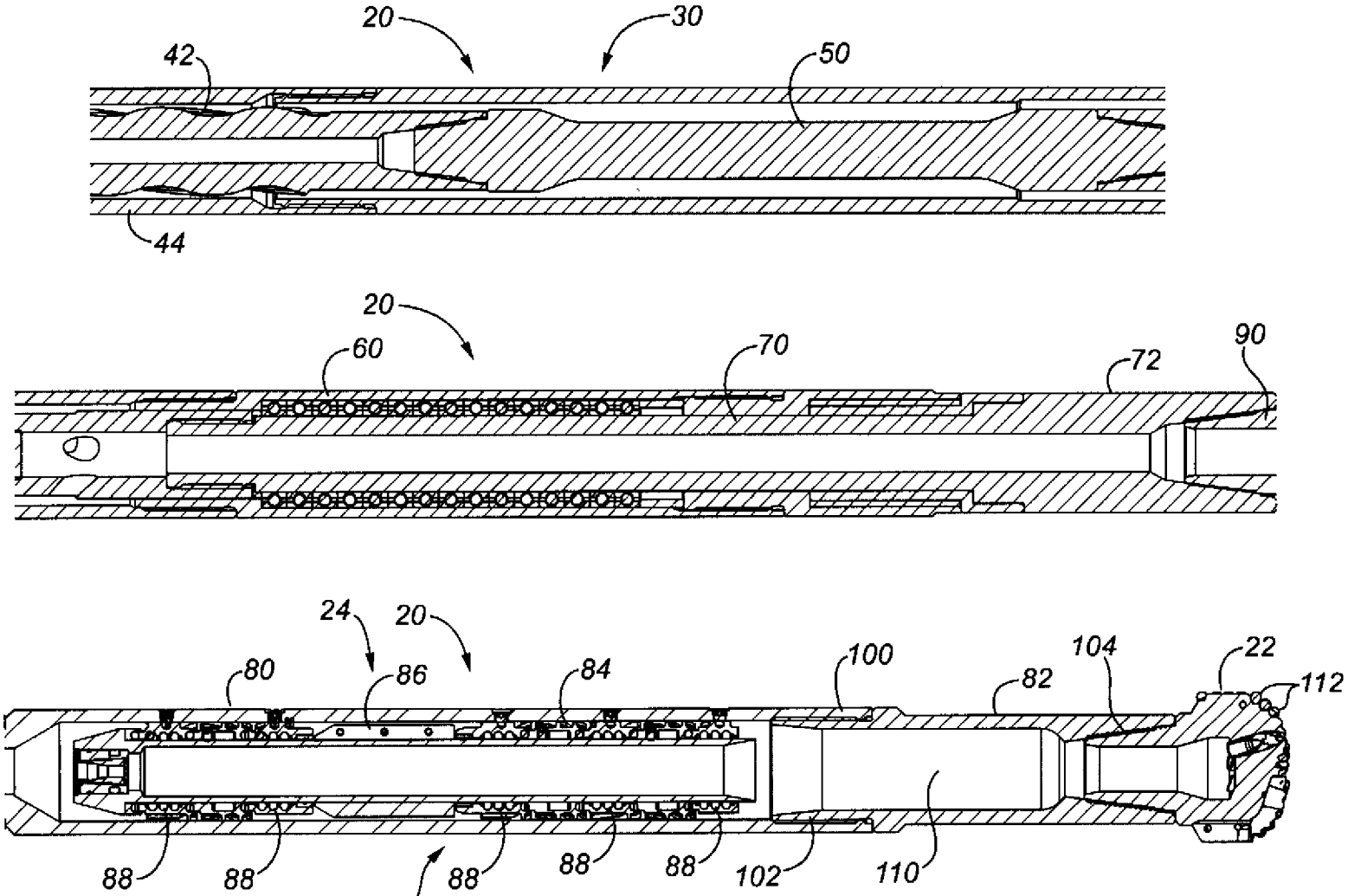
FIG. 1 is a longitudinal cross-section assembly view of an exemplary embodiment of a drilling apparatus according to the first aspect of the invention.

FIG. 1 depicts an exemplary embodiment of a drilling apparatus (20) according to the first aspect of the invention. At the lower end of the drilling apparatus (20) is a drill bit (22). Uphole of the drill bit (22) is a nutation device (24). The nutation device (24) is comprised of a vibrating device. In the exemplary embodiment of the first aspect, the vibrating device is comprised of a mass oscillator (26) for imposing transverse vibrations upon the drilling apparatus (20). Uphole of the nutation device (24) is a downhole drilling motor (30) comprising a Moineau type drilling motor. As a result, in the exemplary embodiment of the first aspect, the nutation device (24) is interposed between the drilling motor (30) and the drill bit (22).

In the exemplary embodiment of the first aspect, the drilling motor (30) is comprised of a power section (40) including a rotor (42) and a stator (44), a transmission section (50) including a flex shaft or a constant velocity joint and a bearing section (60) including thrust bearings and radial bearings. The rotor (42) is connected with an output drive shaft (70). The distal end of the drive shaft (70) includes a threaded bit box (72). In some embodiments, the drilling motor (30) may be straight. In some embodiments, the drilling motor (30) may be bent or may be connected with a bent sub (not shown) in order to facilitate directional drilling.

In the exemplary embodiment of the first aspect, the mass oscillator (26) is comprised of a proximal housing (80), a distal housing (82), at least one fluid driven turbine (84), and at least one eccentric mass (86) which is rotated by the one or more turbines (84). The one or more turbines (84) and the one or more eccentric masses (86) are rotatably contained within the proximal housing (80) and are supported by bearings (88). In the exemplary embodiment of the first aspect, the proximal housing (80), the one or more turbines (84) and the one or more eccentric masses (86) may be similar to the apparatus described in PCT International Publication No. WO 2012/083413 A1 (Bakken).

The distal housing (82) is interposed between the proximal housing (80) and the drill bit (22) and provides additional length to the drilling apparatus (20) in order to achieve a desired vibration frequency of the drilling apparatus (20)

and/or a drilling assembly (not shown). In some embodiments, the distal housing (82) may not be required.

In the exemplary embodiment of the first aspect, the proximal end of the proximal housing (80) includes a threaded connector (90) which is compatible with the threaded bit box (72) on the drive shaft (70) so that the mass oscillator (26) can be connected with the distal end of the drive shaft (70). In the exemplary embodiment of the first aspect, the distal end of the proximal housing (80) includes a threaded box connector (100) which is compatible with a threaded pin connector (102) on the distal housing (82) so that the proximal housing (80) can be connected with the distal housing (82). In embodiments in which the distal housing (82) is not required, a threaded pin connector (104) on the drill bit (22) may be connected directly with the threaded box connector (100) on the distal end of the proximal housing (80).

In the exemplary embodiment of the first aspect, the drilling apparatus (20) defines a bore (110) which extends from the proximal end to the distal end of the drilling apparatus (20). A circulating fluid (not shown) is passed through the bore (110) in order to drive both the drilling motor (30) and the mass oscillator (26).

Driving the drilling motor (30) causes the drive shaft (70), the mass oscillator (26) and the drill bit (22) to rotate at the same speed as the rotor (42), which is thus the rotation frequency of the drill bit (22).

In some embodiments of the first aspect, driving the one or more turbines (84) causes the one or more eccentric masses (86) to rotate at the same speed as the turbines (84). In other embodiments of the first aspect, the eccentric masses (86) may be connected with the turbines (84) with a transmission and/or gears (not shown) so that the rotation frequency of the turbines (84) is converted to a different rotation frequency of the eccentric masses (86). The centripetal force generated by the rotation of the eccentric masses (86) imposes a transverse vibration wave on the proximal housing (80). The transverse vibration wave travels through the distal housing (82) and to the drill bit (22). As used herein, transverse wave describes a wave that is substantially perpendicular to the axis of the drilling apparatus (20).

The transverse wave will induce a cyclical elastic strain or cyclical bending in the housings (80, 82). This elastic strain will act to periodically bend and tilt the housings (80, 82) so that nutation of the drill bit (22) is achieved. This nutation of the drill bit (22) will act to create a longitudinal hammering effect on the rock (not shown) as cutting elements (112) are periodically loaded and unloaded on the end of the borehole, and may additionally provide a relaxation phase between loadings of the cutting elements (112) in which the cutting elements (112) are allowed to cool while unloaded.

Other potential benefits of combining nutation of the drill bit (22) with rotation of the drill bit by a drilling motor (30) may be realized.

First, the transverse vibrations generated by the mass oscillator (26) may help to reduce frictional coefficients in the bearing section (60) of the drilling motor (30). This may help to reduce motor bearing wear and ultimately improve motor life. Reducing frictional coefficients on the motor bearings may be particularly helpful during sliding (steering) drilling.

Figure 2:
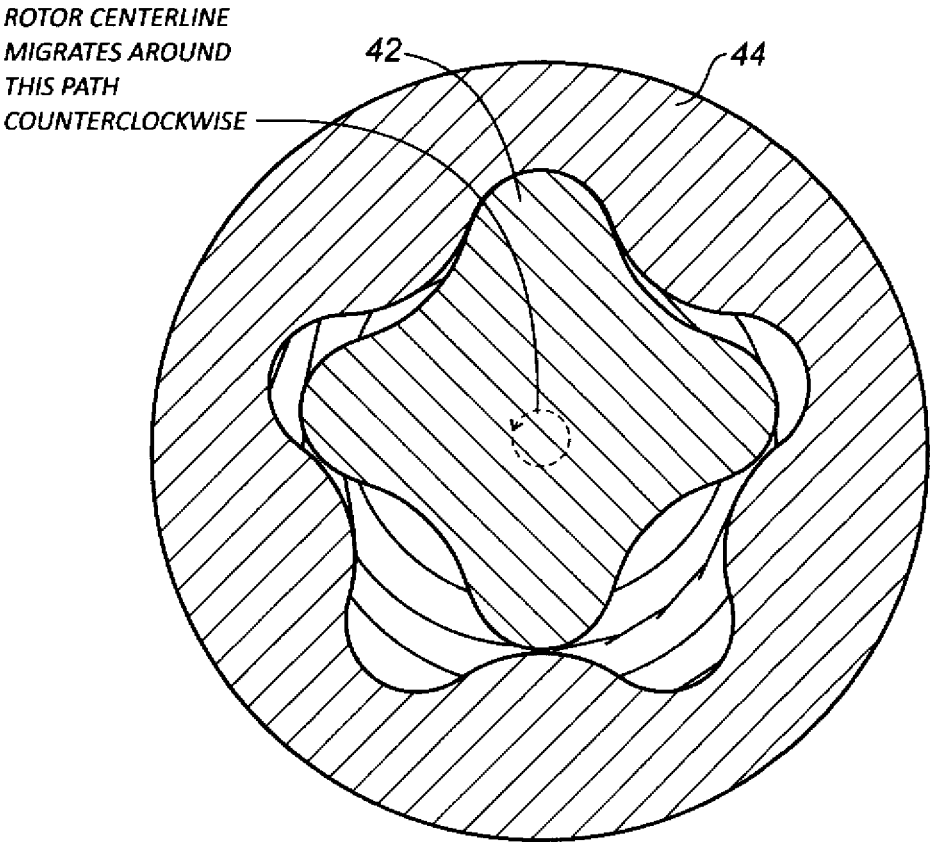
FIG. 2 is a transverse cross-sectional view of a typical downhole drilling motor, showing a typical precession of the centerline of the rotor relative to the centerline of the drilling motor.

Second, other benefits may be realized by considering the Moineau mechanism of the drilling motor (22) of the exemplary embodiment. Referring to FIG. 2, there is depicted a cross section of the rotor (42) and the stator (44) of a typical Moineau type drilling motor (30). It is noted that in essence, a Moineau mechanism also functions as a mass oscillator (26) due to the fact that the rotor (42) migrates around the centerline of the stator (44). This migration creates a centripetal force in much the same way as described above, which in turn also creates a transverse wave that may induce nutation of the drill bit (22). A fundamental difference is that the rotor (42) migrates in a counter clockwise direction (looking downhole) while the rotor (42) is rotated clockwise. This motion may introduce a slight negative velocity or rotation to the cutting elements (112) on the drill bit (22). This counter clockwise nutation may be detrimental to cutting element life (particularly polycrystalline diamond (PDC) cutting elements which tend not to perform well when rotating backwards). It is believed that by adding the nutation device (24) below the drilling motor (30) which introduces a clockwise nutation in the drill bit (22), the counter clockwise nutation created by the power section (40) can effectively be cancelled out by the nutation produced by the nutation device (24).

Figure 3:
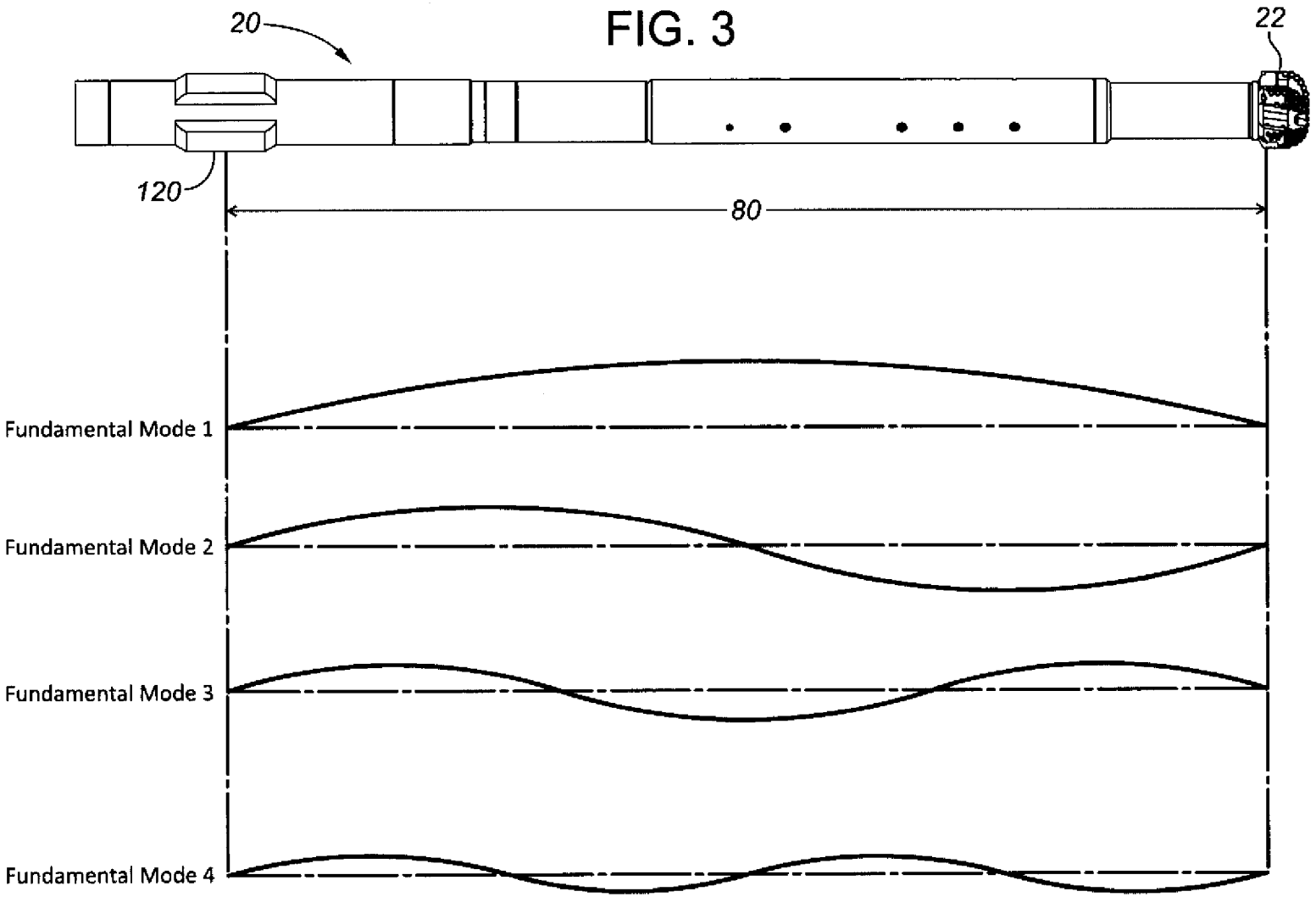
FIG. 3 is a schematic side view of an exemplary drilling assembly incorporating the drilling apparatus of FIG. 1, including a kickpad or stabilizer positioned proximal or uphole of the drilling apparatus, and of schematic depictions of fundamental transverse vibration modes 1-4 for the exemplary drilling assembly.

FIG. 3 depicts an exemplary drilling assembly configuration incorporating an exemplary drilling apparatus (20) according to the first aspect of the invention. In the exemplary drilling assembly configuration of FIG. 3, a kickpad or stabilizer (120) may be positioned within or above the drilling apparatus (20) to provide an upper "contact" point with a borehole (not shown) which may serve as an "upper node" (or at least a quasi-nodal point) when transverse waves are generated by the drilling apparatus (20) (since the kickpad or stabilizer does not totally restrict lateral movement of the drilling assembly in the borehole this upper node may be considered to be quasi-nodal). Similarly, the drill bit (22) provides a lower "contact" point with the end of the borehole which may serve as a "lower node" (or at least a quasi-nodal point) when transverse waves are generated by the drilling apparatus (20).

In the exemplary drilling assembly configuration of FIG. 3, it is believed that at least a portion of the transverse wave energy will be reflected downward from the kickpad or stabilizer (120) and upward from the drill bit (22). The superposition of these reflected waves may result in a resonant standing wave pattern. When a resonant standing wave pattern is achieved, it is believed that maximum energy will be delivered to the drill bit (22) and maximum loading and unloading of the cutting elements (112) will be achieved.

Figure 4:
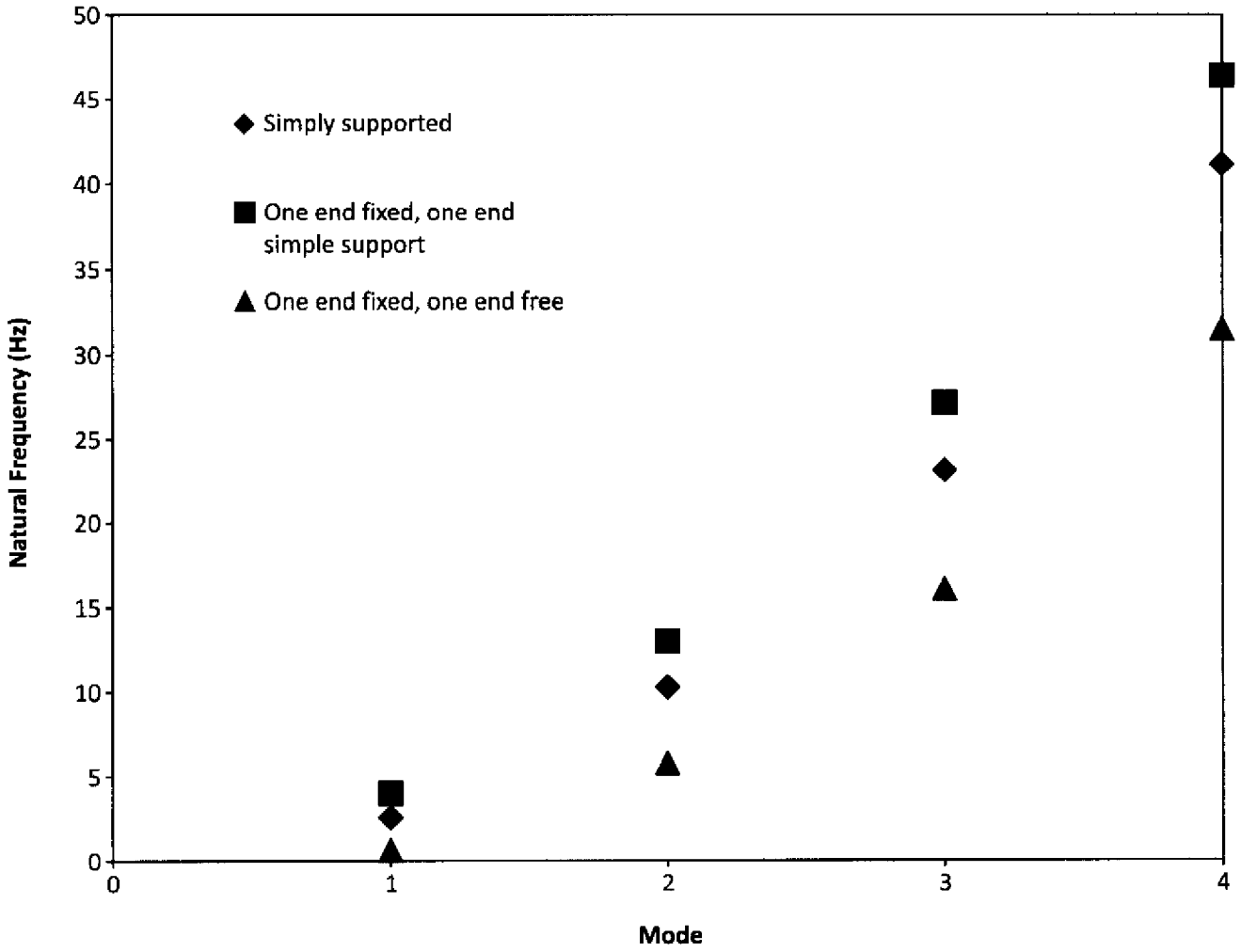
FIG. 4 is a graph depicting theoretical resonant frequencies for the exemplary drilling assembly of FIG. 3, calculated using elementary beam theory assuming three different end loading conditions.

Hypothetical resonant frequencies for the exemplary drilling assembly configuration of FIG. 3 are provided in FIG. 4. These resonant frequencies have been calculated using elementary beam theory for three different end loading conditions. It is believed that operating the mass oscillator (26) below or around 50 Hz is likely to be most practical. It is also believed that operating at too low of a frequency is most likely not practical (Resonant Mode 1 or Resonant Mode 2). The base level of energy (or lateral force) being generated by the mass oscillator (26) at low frequencies may be insufficient to overcome damping effects in the system. As a result, a preferable option may be to target Resonant Mode 3 or Resonant Mode 4 as the transverse vibration frequency of the mass oscillator (26) in the practice of the method of the invention.

In the exemplary embodiment of the drilling apparatus (20) and the exemplary drilling assembly configuration according to the first aspect of the invention, the location of the eccentric masses (86) relative to the upper node (as a non-limiting example, the kickpad or stabilizer (120)) and the lower node (i.e., the drill bit (22)) is preferably selected to provide an effective lever arm between the eccentric masses (86) and the upper and lower nodes. If the eccentric masses (86) and/or the bearings (88) that support the eccentric masses (86) are too close to the upper and lower nodes, it may be difficult to create sufficient transverse (elastic) displacement of the housings (80, 82) between the eccentric mass and the upper and lower nodes.

In the exemplary embodiment of the drilling apparatus (22) and the exemplary drilling assembly configuration according to the first aspect of the invention, the length of the mass oscillator (26) is preferably minimized to enable control over the drilling direction if directional drilling with the drilling assembly is contemplated. In the exemplary embodiments of the first aspect of the invention, the length of the drilling apparatus (20) from the distal end of the drilling motor (30) to the drill bit (22) is preferably no greater than about 50 inches if directional drilling is contemplated.

Figure 5:
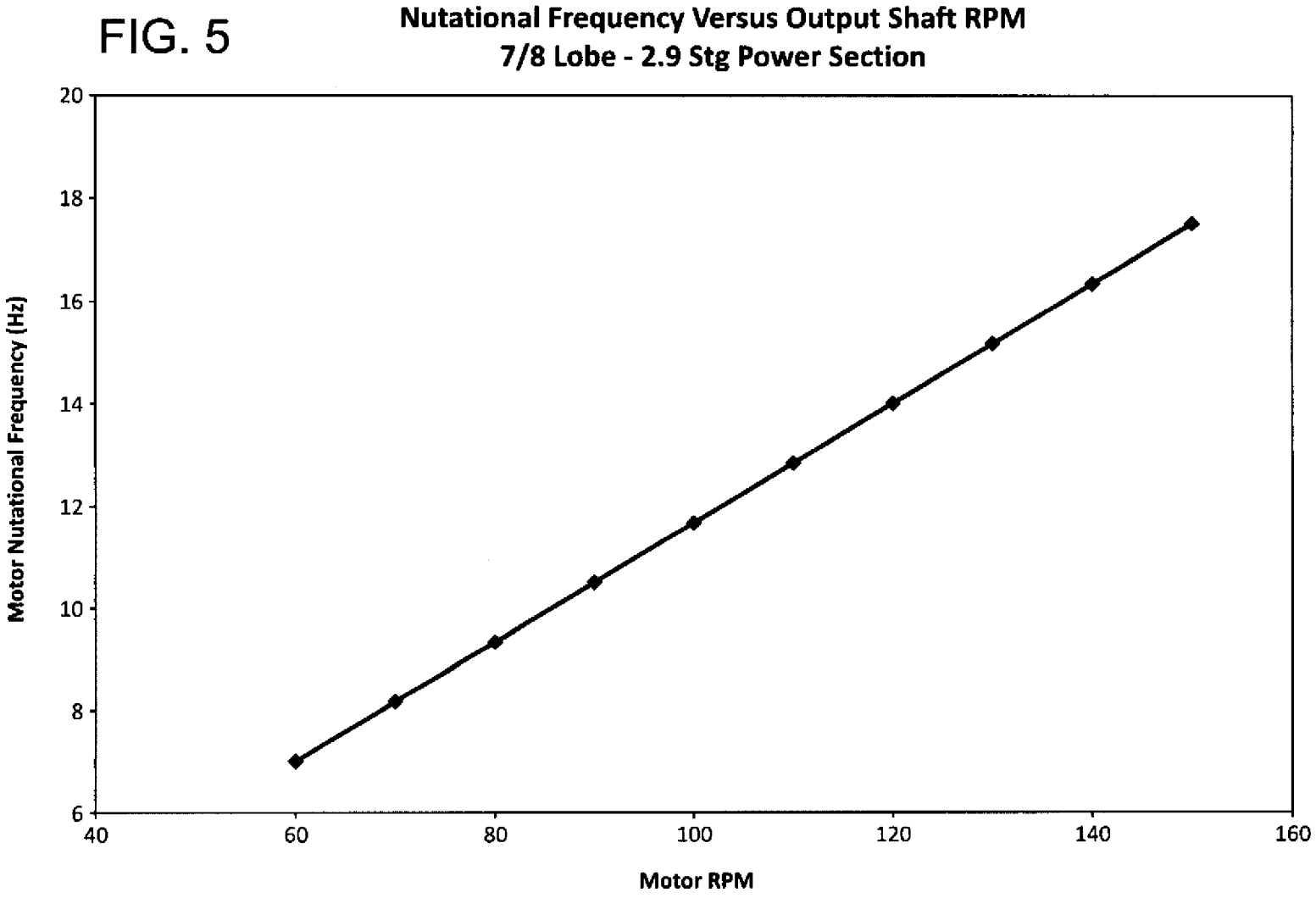
FIG. 5 is a graph depicting typical nutation frequency as a function of output shaft revolutions per minute for a typical drilling motor.

The drilling apparatus (22) of the first aspect of the invention may also be useful to reduce frictional sliding coefficients between the borehole and components of the drilling assembly such as the kickpad or stabilizer (120). It is well known that the friction developed at the kickpad (120) on a drilling motor while sliding drilling is not desirable. Although the optimum transverse vibration frequency for reducing this friction is not currently known, it is believed that the optimum transverse vibration frequency for reducing friction may be higher (or at least different) than that produced by a typical Moineau type motor. For reference, FIG. 5 shows the calculated nutation frequencies of a standard motor in the industry. As a result, the operation of the mass oscillator (26) in the present invention may be useful both to provide nutation to the drill bit (22) and to reduce friction in the drilling assembly, particularly if the mass oscillator (26) is tuned to provide a transverse vibration frequency which is higher (or at least different) than the nutation frequency of the drilling motor (30).

In the operation of the drilling apparatus (22) of the first aspect of the invention and in the practice of the method of the first aspect of the invention, it may be preferable to enable control over the vibration frequency of the mass oscillator (26) so that the mass oscillator (26) can be tuned to provide appropriate vibration frequencies for different configurations of drilling assembly and different drilling parameters and conditions.

Generally, there is a fairly direct correlation between turbine speed and volume flow rate of fluid through a turbine. As a result, tuning of the mass oscillator (26) may conceivably be achieved at least in part by controlling the volume flow rate of fluid through the turbines (84). As a non-limiting example, the mass oscillator (26) could therefore be provided with a bypass valve (not shown in FIGS. 1-5) operating on a pressure differential, centrifugal principle or other parameter related to the operation of the mass oscillator (26) in order to enable an automatic or semi-automatic tuning to "lock in" to the most effective vibration frequency for a specific drilling assembly configuration and drilling parameters and conditions.

Tuning the mass oscillator (26) to provide a single vibration frequency may be impractical in at least some applications.

As an alternative to tuning the mass oscillator (26) to provide a single vibration frequency, a second aspect of the invention is directed at providing a range of vibration frequencies between a lower frequency limit and an upper frequency limit. In some embodiments of the second aspect, the range of vibration frequencies may include a desired vibration frequency.

Figure 6:
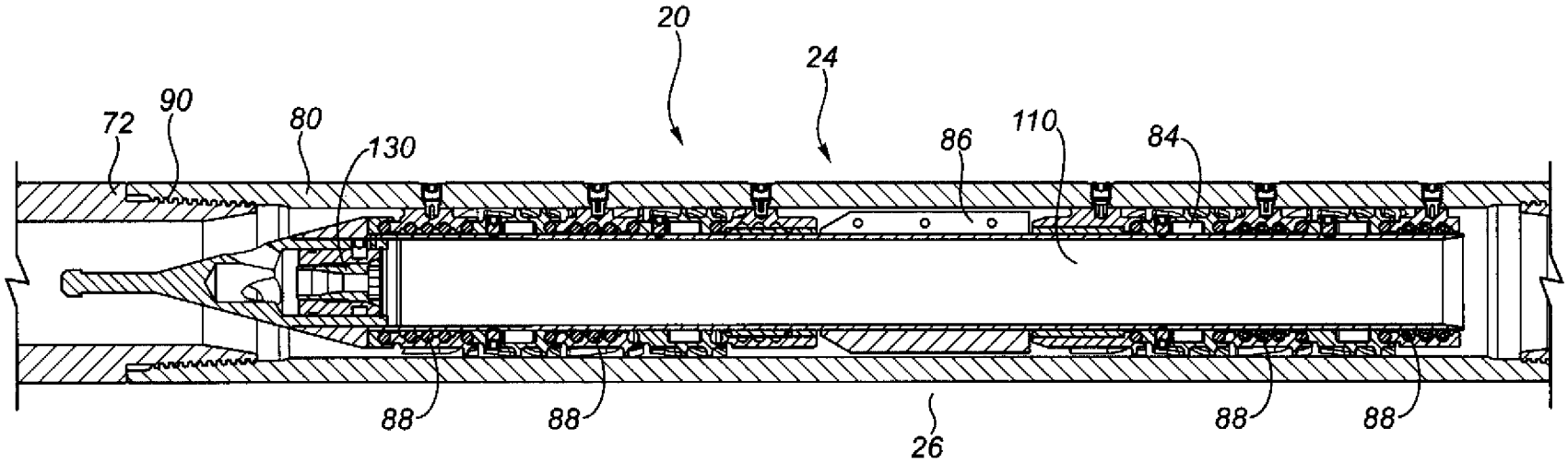
FIG. 6 is a longitudinal cross-section assembly view of a mass oscillator which is comprised of at least one fluid driven rotatable turbine and at least one eccentric mass rotatably connected with the turbine.

FIG. 6 depicts an embodiment of a downhole mass oscillator (26) which is comprised of at least one fluid driven rotatable turbine (84) and at least one eccentric mass (86) rotatably connected with the at least one turbine (84). The vibration frequency of the mass oscillator (26) is roughly proportional to the flow rate directed through the turbines (84). The eccentric masses (86) may rotate at the same rotation frequency as the turbines (84), or the eccentric masses (86) may rotate at a different rotation frequency than the turbines (84), depending upon how the eccentric masses (86) are connected with the turbines (84). In some embodiments, a transmission and/or gears (not shown) may be interposed between the eccentric masses (86) and the turbines (84) to convert the rotation frequency of the turbines (84) into a different rotation frequency of the eccentric masses (86).

Without the novel and inventive approach of the second aspect of the invention as described hereafter, this mass oscillator (26) may experience some or all of the disadvantages of Eddison et al. Flanders et al, Seutter et al and Fincher et al.

In the second aspect of the invention, the volume flow rate of fluid through the turbines (84) is varied cyclically on an ongoing and/or continuous basis during use of the mass oscillator (26) so that the rotation frequency of the mass oscillator (26) varies between an upper frequency limit and a lower frequency limit of a vibration frequency range. By varying the volume flow rate, the vibration frequency of the mass oscillator (26) "sweeps" through the vibration frequency range. A desired vibration frequency of the system, such as a desired resonant mode frequency, may be contained within the vibration frequency range. The cycle would then repeat itself. Thus, the resonant mode frequency is always achieved for a finite period of time during the course of each cycle. The vibration frequency range may be relatively wide or relatively narrow, depending upon the application of the second aspect of the invention and depending upon the extent of the fluctuation of a desired vibration frequency of the system.

Figure 7A:
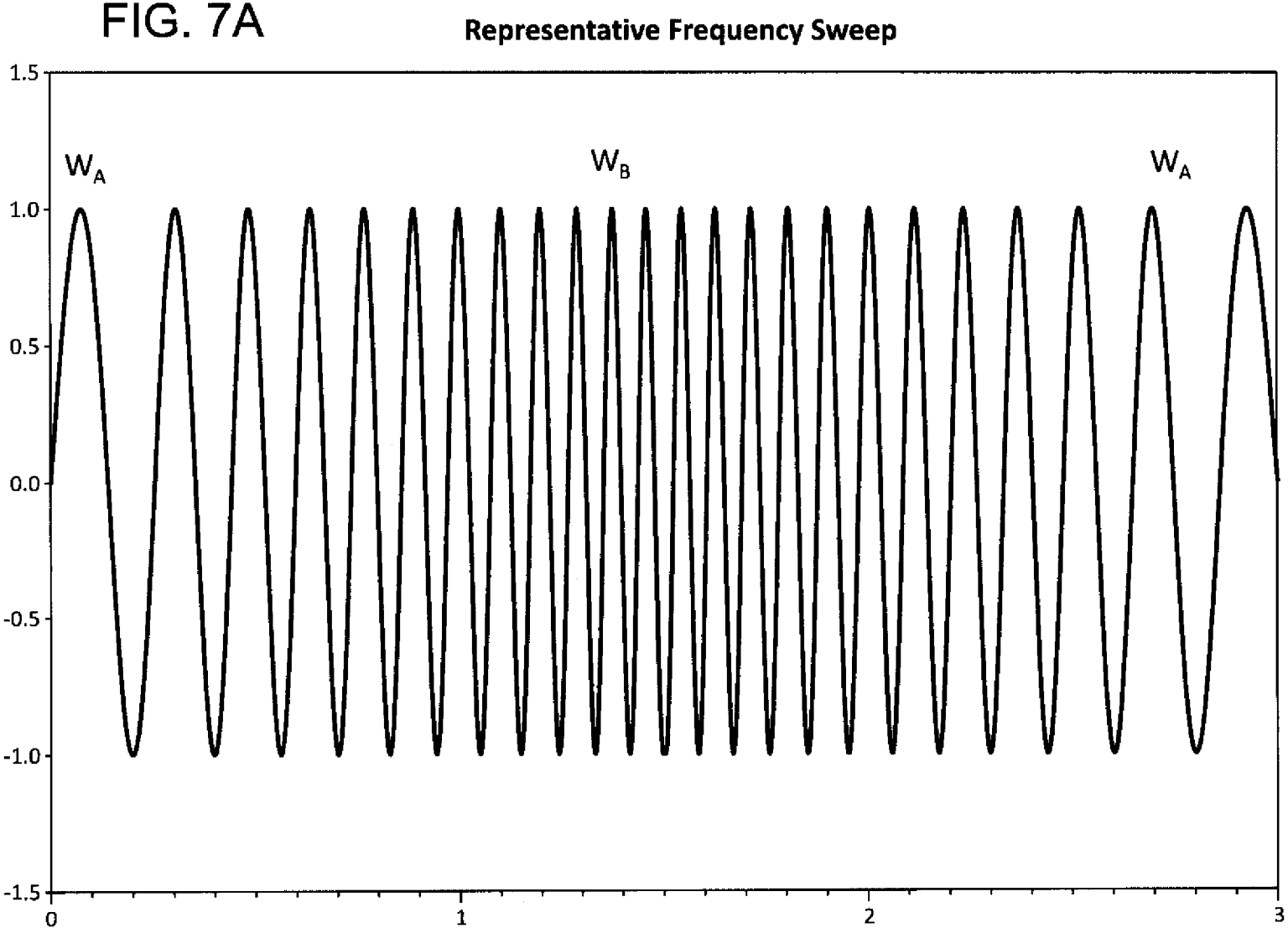
FIG. 7A is a graph depicting a representative frequency sweep between a lower frequency limit $W_A$ and an upper frequency limit $W_B$ as the vibration frequency of a turbine and/or an eccentric mass as a function of time.
Figure 7B:
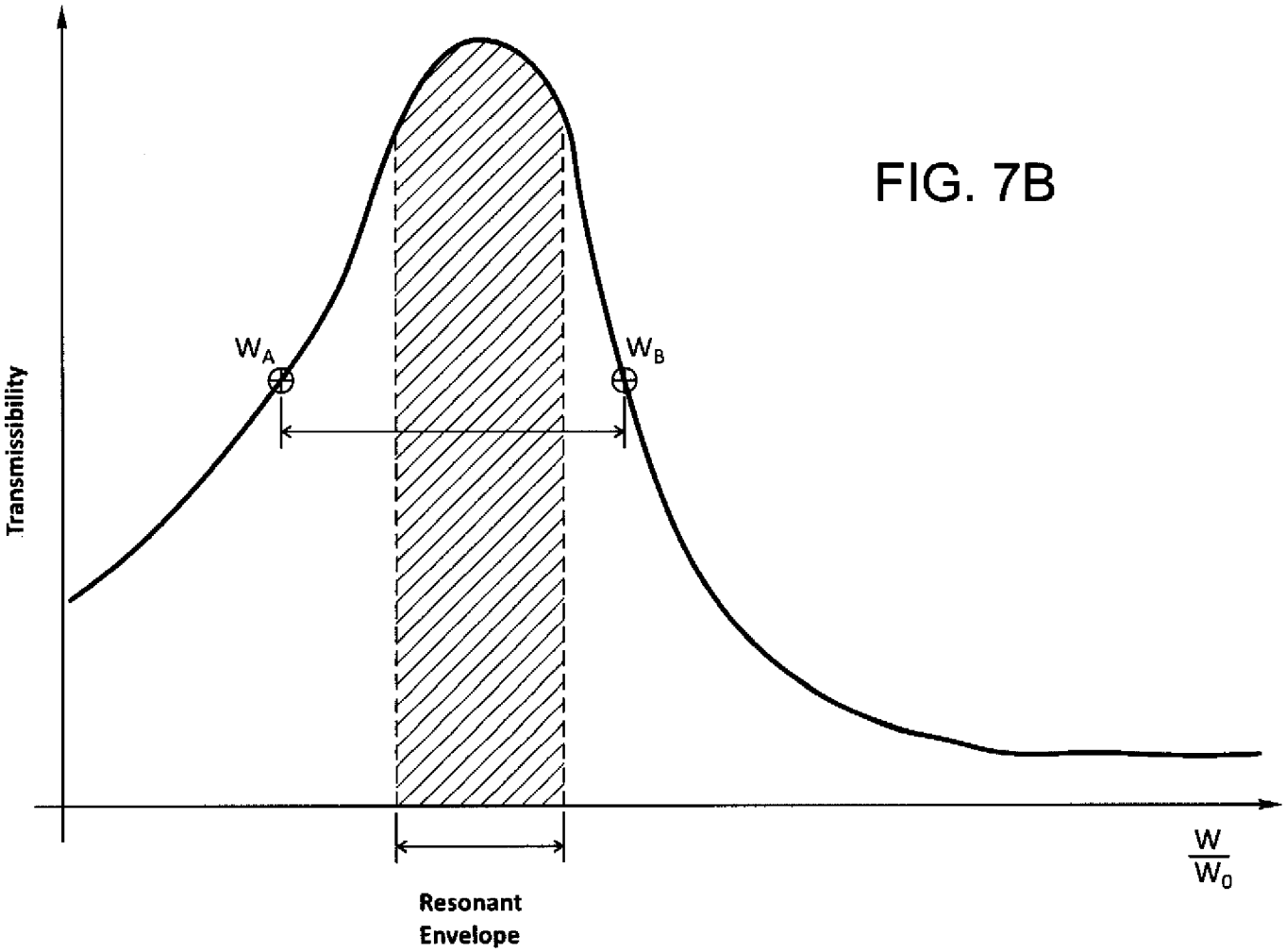
FIG. 7B is a graph depicting a resonant envelope between lower frequency limit $W_A$ and an upper frequency limit $W_B$ wherein a resonant mode frequency is achieved during a frequency sweep.

FIG. 7A is a graphical representation of how the vibration frequency of the mass oscillator (26) could change over time. The vibration frequency may be considered to be analogous to a frequency modulated wave used in radio transmission. A mechanical analogy would be the manner in which a grinder with an unbalanced wheel interacts with the bench it is mounted on as it speeds up and slows down. FIG. 7B is a graphical representation of a resonant envelope between a lower frequency limit $W_A$ and an upper frequency limit $W_B$, wherein a resonant mode frequency is achieved during a "sweep" between the lower frequency limit $W_A$ and the upper frequency limit $W_B$.

In some embodiments of the first aspect and the second aspect, a means of achieving a desired vibration frequency of a mass oscillator (26) and/or a cyclical varying or sweep of the vibration frequency of a mass oscillator (26) may be to provide a bypass valve (130) that will bypass a time variable amount of fluid flow around the turbines (84). In some embodiments, the bypass valve (130) may be located in the internal bore of the mass oscillator (26) as depicted in FIG. 6.

In some embodiments of the second aspect, the operating speed, operating frequency, and/or valve cycling frequency of the bypass valve (130) may be lower than the rotation frequency of the turbines (84) and/or the eccentric masses (86). In some embodiments, the valve cycling frequency of the bypass valve (130) may be substantially and/or significantly lower than the rotation frequency of the turbines (84) and/or the eccentric masses (86).

In some embodiments of the second aspect, as a non-limiting example, the turbines (84) and the eccentric masses (86) may have a rotation frequency of between about 20 Hz (1200 rpm) and about 60 Hz (3600 rpm), while the bypass valve (130) may have a valve cycling frequency of between about 0.1 Hz and about 1 Hz.

In some embodiments of the second aspect, the actuation of the bypass valve (130) may be slow enough to allow time for acceleration and deceleration of the turbines (84) as the fluid flow rate through the turbines (84) varies. In some embodiments, the actuation of the bypass valve (130) may be slow enough so that a quasi-equilibrium may be reached at the resonant mode frequency whereby standing waves can begin to constructively interfere.

The bypass valve (130) may be actuated cyclically in any suitable manner. In some embodiments, the bypass valve (130) may be actuated cyclically in a sinusoidal manner. In some embodiments, the bypass valve (130) may be actuated cyclically in a non-sinusoidal manner. In some embodiments, the bypass valve (130) may be actuated cyclically in a linear manner. In some embodiments, the bypass valve (130) may be actuated cyclically in a non-linear manner. In some embodiments, the bypass valve (130) may be actuated cyclically in a symmetrical manner. In some embodiments, the bypass valve (130) may be actuated cyclically in a non-symmetrical manner.

In some embodiments of the second aspect, as non-limiting examples, the flow area through the bypass valve (130) may vary linearly over time or the flow area through the bypass valve (130) may vary in a stepwise (on/off) fashion with an appropriate lag time between. A number of types of valve may be suitable for use in the present invention as a bypass valve (130). As a result, the specific embodiments and configurations of bypass valve (130) depicted in FIGS. 8-10 and described hereafter are intended to be non-limiting.

Figure 8:
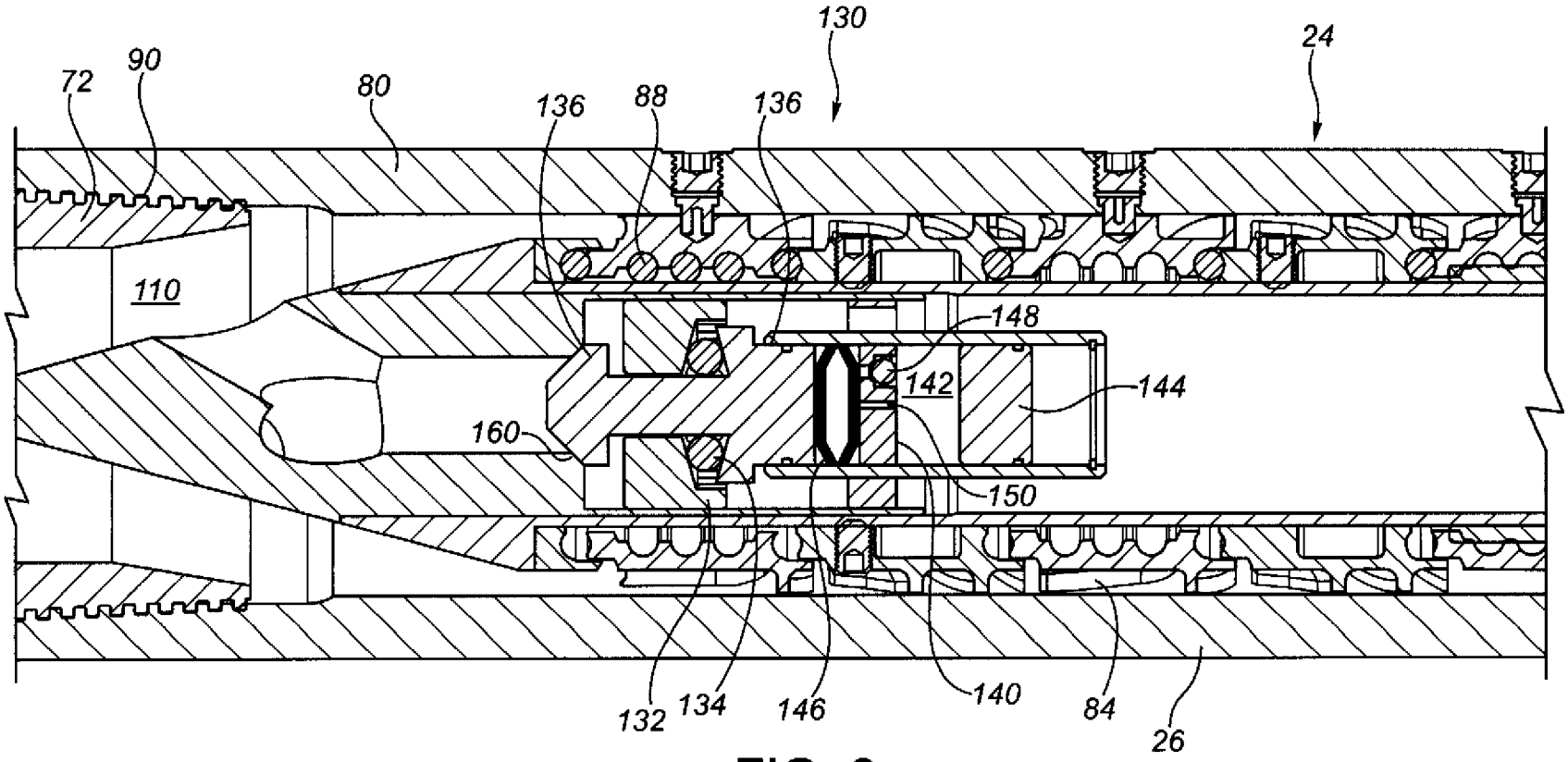
FIG. 8 is a longitudinal cross-section assembly view of the mass oscillator of FIG. 6, including a non-limiting embodiment of a mechanical bypass valve.

FIG. 8 depicts a non-limiting embodiment of a mechanical bypass valve (130) which may be suitable for use in the second aspect of the invention. In the FIG. 8 embodiment, the bypass valve (130) comprises a centrifugal switch (132) comprising ball elements (134) that move radially to actuate a linear poppet (136).

The bypass valve (130) of FIG. 8 further comprises a hydraulic timer (140). The hydraulic timer (140) comprises a hydraulic chamber (142) which houses a piston end of the poppet (136) at a first end and a compensating piston (144) at a second end, a biasing spring (146) comprising bistable spring elements which urges the poppet (136) out of the hydraulic chamber (142), and a one-way high flow check valve (148) and a two-way metering orifice (150) contained within the hydraulic chamber (142) axially between the poppet (136) and the compensating piston (144). The check valve (148) and the metering orifice (150) are configured to allow fluid to enter and leave the hydraulic chamber (142) to provide for initial rapid deceleration of the turbines (84) followed by gradual acceleration of the turbines (84). As a result, the bypass valve (130) of FIG. 8 operates in a non-symmetrical manner.

As depicted in FIG. 8, the ball elements (134) are configured to travel radially outward (i.e., perpendicular to the axis of rotation of the turbines (84)) in response to rotation of the turbines (84). As the ball elements (134) move radially outward, inclined surfaces engaged with the ball elements (134) translate this outward radial movement to an axial displacement of the poppet (136) away from a nozzle restriction (160). As the poppet (136) is displaced away from the nozzle restriction (160), fluid flow is diverted from the turbines (84) to the bypass route provided through the nozzle restriction (160) by the bypass valve (130), so that the turbines (84) decelerate. Furthermore, as the poppet (136) is displaced away from the nozzle restriction (160), the piston end of the poppet (136) forces the bistable spring elements of the biasing spring (146) to collapse, and oil or some other fluid is pumped through both the check valve (148) and the metering orifice (150) so that the poppet (136) can be displaced away from the nozzle restriction (160) relatively quickly.

As the rotation speed of the turbines (84) decreases in response to the diversion of fluid flow through the nozzle restriction (160), the ball elements (134) move radially inward, allowing the bistable spring elements of the biasing spring (146) to decompress as the ball elements (134) move radially inward, but at a relatively slow rate through only the metering orifice (150) which is located in the central bulkhead between the poppet (136) and the compensating piston (144). As the bistable spring elements gradually decompress, the piston end of the poppet (136) moves back toward the nozzle restriction (160) so that the nozzle restriction (160) becomes gradually blocked and the diversion of fluid flow from the turbines (84) is gradually reduced. The metering orifice (150) therefore allows for a period of gradual acceleration of the turbines (84) before the actuation cycle of the bypass valve (130) repeats itself.

Figure 9:
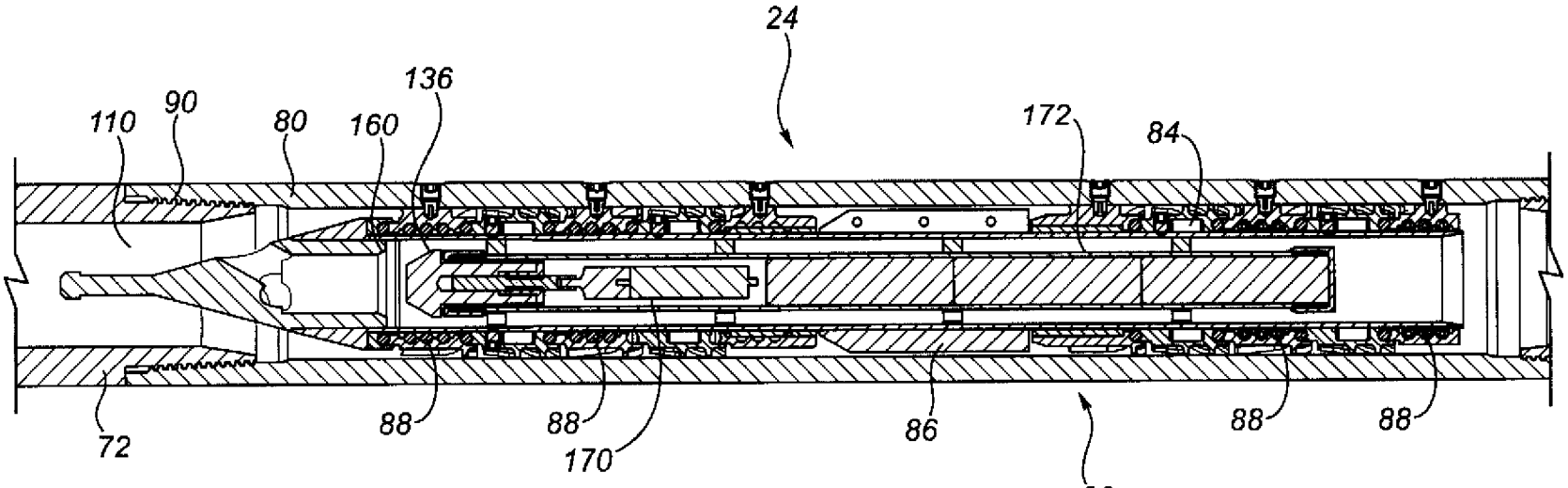
FIG. 9 is a longitudinal cross-section assembly view of the mass oscillator of FIG. 6, including a non-limiting embodiment of an electronic bypass valve.

FIG. 9 depicts a non-limiting embodiment of an electronic bypass valve (130) that may be suitable for use in the second aspect of the invention. This electronic bypass valve (130) could be similar in nature to a positive pulsing device used in directional drilling telemetry. As depicted in FIG. 9, a poppet (136) would be moved linearly with respect to a nozzle restriction (160) via a solenoid, electric motor and ball screw assembly (170), and/or by some other electrically powered device. The electric motor could be powered by a battery bank (172) and controlled via onboard hardware. This arrangement allows for easy and reliable regulation of the cycles of the bypass valve (130). Due to the relatively low number of cycles (low frequency) that the bypass valve (130) would need to perform, current battery technology could allow for a relatively high powered assembly (170) to be utilized. Cycling of the bypass valve (130) could commence once a threshold hydrostatic pressure is detected by an onboard sensor (not shown). Power for the assembly (170) could also conceivably be generated by an alternator (not shown) built directly into the turbines (84).

Figure 10:
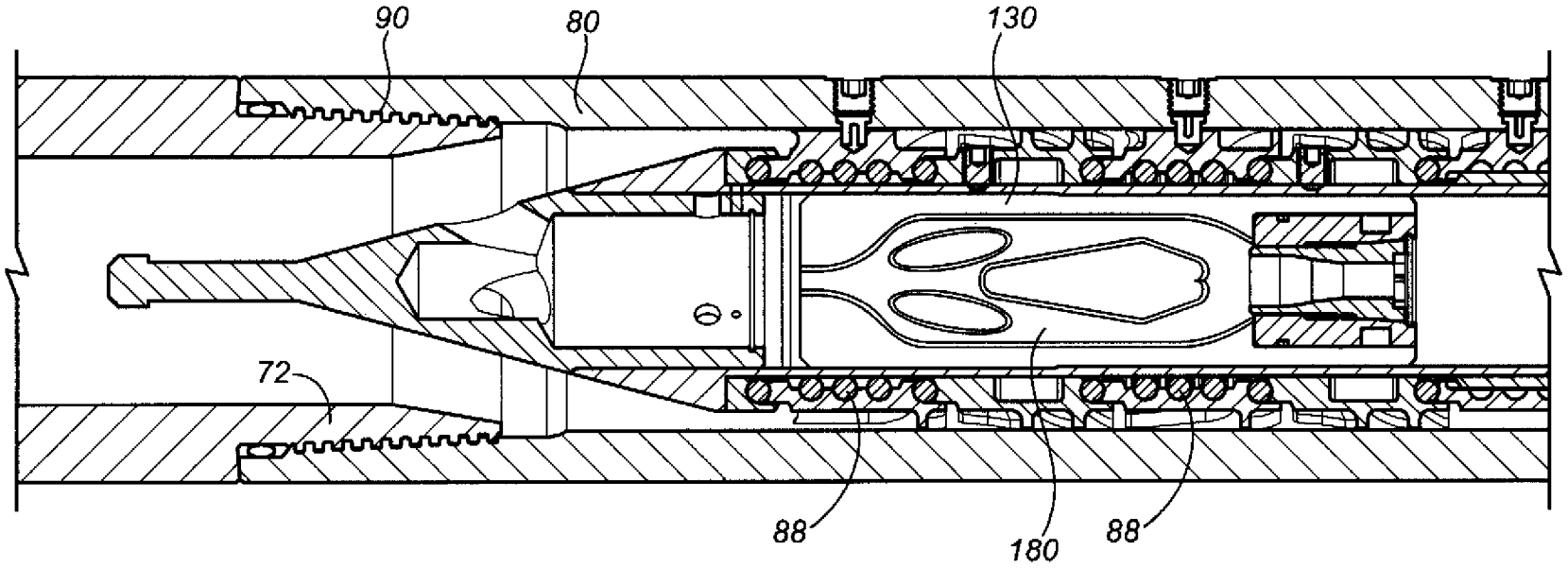
FIG. 10 is a longitudinal cross-section assembly view of the mass oscillator of FIG. 6, including a non-limiting embodiment of fluidic bypass valve.

FIG. 10 depicts a non-limiting embodiment of a fluidic bypass valve (130) which may be suitable for use in the second aspect of the invention. As depicted in FIG. 10, an oscillating pressure in a fluid bypass is provided by a fluidic oscillating (FO) valve (130). This oscillating pressure effectively provides an oscillating restriction of fluid flow through the bypass valve (130) and a fluid bypass route (180). Fluidic oscillating valves are potentially desirable for use in the second aspect of the invention because they contain no moving parts and are typically very reliable. However, it is possible that the range of pulsing frequencies that can be provided by a fluidic oscillating valve may be outside of the range of frequencies which is practical for use in the second aspect of the invention (i.e., the oscillation frequency of a fluidic oscillating valve may be too high).

The second aspect of the invention may be used independently of the first aspect of the invention, and/or may be suitable for use in conjunction with the first aspect of the invention.

Referring to FIG. 1, a testing configuration is depicted for imposing transverse vibrations on a pipe string (190) by a mass oscillator (26) in accordance with the second aspect of the invention. In the testing configuration of FIG. 11, a test pipe string (190) comprising the mass oscillator (26) and a length of about 720 inches of drill pipe is supported between two simple supports. In the testing configuration, the drill pipe is constructed of steel, with an outside diameter of 4 inches and a weight of 15.7 pounds per foot. This testing configuration may be broadly representative of conditions which may be encountered in a typical borehole in some circumstances.

Figure 11:
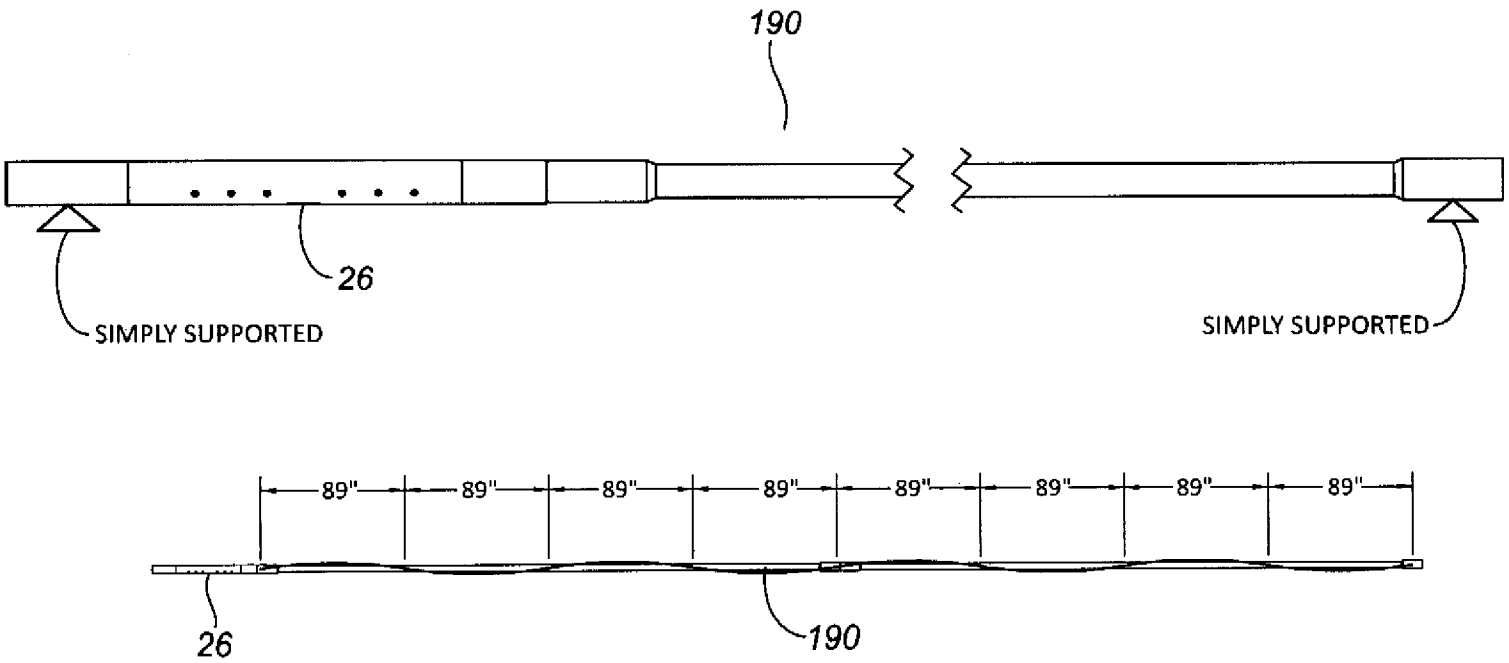
FIG. 11 is a schematic view of a testing configuration in which transverse vibrations were applied to a pipe string by a mass oscillator in accordance with the second aspect of the invention.

Using the testing configuration of FIG. 11, it was discovered through empirical testing that a maximum lateral acceleration of the test pipe string (190) occurred at a transverse vibration frequency of the mass oscillator (26) of about 50 Hz. In the empirical testing, the maximum lateral acceleration of the pipe string (190) was found to be about 386 $ft/s^2$ at a transverse vibration frequency of the mass oscillator (26) of about 50 Hz.

Figure 12:
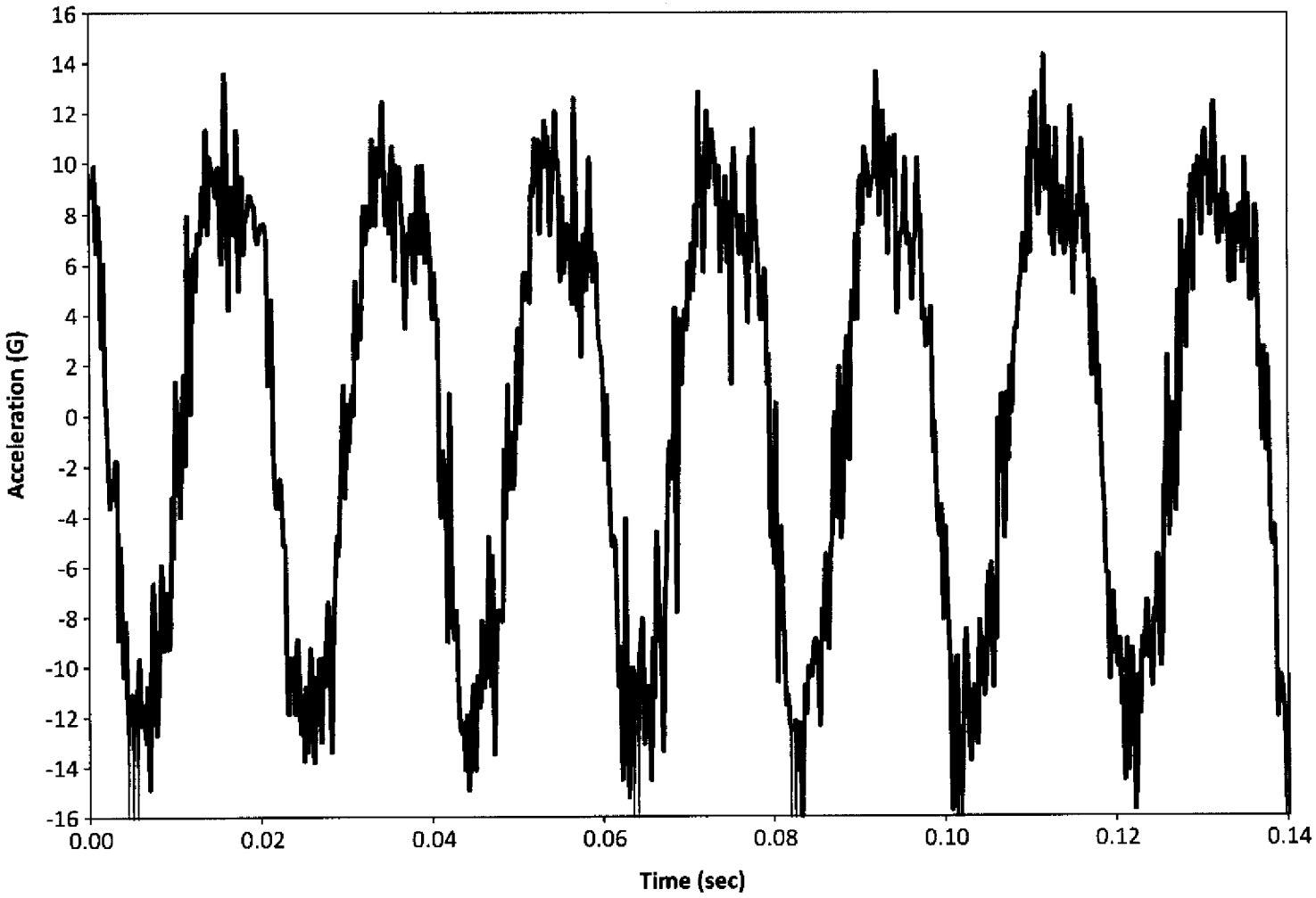
FIG. 12 is a graph depicting lateral acceleration of the pipe string of FIG. 11 as a function of time at a vibration frequency of the mass oscillator of about 50 Hz.

Referring to FIG. 12, a graph depicting lateral acceleration of the test pipe string (190) of FIG. 11 as a function of time at a vibration frequency of the mass oscillator (26) of about 50 Hz.

As depicted in FIGS. 11-12, a vibration frequency of about 50 Hz appears to represent a resonant mode frequency in the test pipe string (190) in accordance with Resonant Mode 4, in which the wavelength is about 178 inches and the half wavelength is about 89 inches.

Based upon the empirical testing using the testing configuration, it is believed that a vibration frequency of a mass oscillator (26) of about 50 Hz may be effective to achieve benefits by laterally vibrating a pipe string (190) in at least some pipe strings under at least some conditions and circumstances.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

What is claimed is:

1. A drilling apparatus comprising:

(a) a drill bit;

(b) a downhole drilling motor comprising a rotor and a stator;

(c) a drive shaft connected with the rotor; and (d) a mass oscillator for imposing transverse vibrations upon the drilling apparatus at a transverse vibration frequency, thereby causing the drill bit to nutate at a nutation frequency, wherein the mass oscillator comprises a housing, wherein the housing of the mass oscillator is connected with the drive shaft and with the drill bit so that driving the drilling motor causes the drive shaft, the housing of the mass oscillator and the drill bit to rotate at a rotation frequency of the drill bit, and wherein the drilling apparatus is configured so that the drilling motor rotates the drill bit at the rotation frequency while the mass oscillator simultaneously nutates the drill bit at the nutation frequency.

2. The drilling apparatus as claimed in claim 1, further comprising a tuning mechanism for tuning the transverse vibration frequency of the mass oscillator.

3. The drilling apparatus as claimed in claim 2 wherein the tuning mechanism tunes the transverse vibration frequency of the mass oscillator automatically.

4. The drilling apparatus as claimed in claim 1 wherein the transverse vibration frequency of the mass oscillator cyclically sweeps through a vibration frequency range which extends between a lower frequency limit and an upper frequency limit.

5. The drilling apparatus as claimed in claim 4, further comprising a tuning mechanism for tuning the vibration frequency range of the mass oscillator.

6. The drilling apparatus as claimed in claim 5 wherein the tuning mechanism tunes the vibration frequency range of the mass oscillator automatically.

7. The drilling apparatus as claimed in claim 1 wherein the mass oscillator is comprised of at least one turbine and at least one eccentric mass and wherein rotating the turbine rotates the eccentric mass.

8. The drilling apparatus as claimed in claim 7, further comprising a tuning mechanism for tuning the transverse vibration frequency of the mass oscillator and wherein the tuning mechanism is comprised of a bypass valve for diverting at least a portion of a fluid flow so that the portion of the fluid flow does not pass through the turbine.

9. The drilling apparatus as claimed in claim 8 wherein the bypass valve is actuated in response to a parameter related to the operation of the mass oscillator.

10. The drilling apparatus as claimed in claim 9 wherein the bypass valve is actuated automatically or semi-automatically.

11. A drilling assembly comprising a drilling apparatus as claimed in claim 1.

12. The drilling assembly as claimed in claim 11 wherein the drilling assembly further comprises a kickpad or stabilizer for defining an upper node of the drilling assembly.

13. A drilling method comprising:

(a) providing a drilling apparatus comprising:

(i) a drill bit;

(ii) a downhole drilling motor comprising a rotor and a stator;

(iii) a drive shaft connected with the rotor; and (iv) a mass oscillator for imposing transverse vibrations upon the drilling apparatus at a transverse vibration frequency, thereby causing the drill bit to nutate at a nutation frequency, wherein the mass oscillator comprises a housing, and wherein the housing of the mass oscillator is connected with the drive shaft and with the drill bit so that driving the drilling motor causes the drive shaft, the housing of the mass oscillator and the drill bit to rotate at a rotation frequency of the drill bit; and (b) simultaneously actuating the drilling motor and actuating the mass oscillator so that the drilling motor rotates the drill bit at the rotation frequency while the mass oscillator simultaneously nutates the drill bit at the nutation frequency.

14. The drilling method as claimed in claim 13 wherein the rotation frequency is greater than the nutation frequency.

15. The drilling method as claimed in claim 13 wherein the mutation frequency is a resonant mode frequency of the drilling assembly.

16. The drilling method as claimed in claim 15 wherein the resonant mode frequency is a Resonant Mode 3 frequency or a Resonant Mode 4 frequency.

17. The drilling method as claimed in claim 13, further comprising timing the nutation frequency for a specific drilling assembly configuration.

18. The drilling method as claimed in claim 13, further comprising tuning the nutation frequency for specific drilling parameters and conditions.

19. The drilling method as claimed in claim 13, further comprising tuning the nutation frequency to achieve a resonant mode frequency of the drilling assembly.

20. A system comprising:

(a) a drilling apparatus comprising:

(i) a drill bit;

(ii) a downhole drilling motor comprising a rotor and a stator;

(iii) a drive shaft connected with the rotor; and (iv) a mass oscillator for imposing transverse vibrations upon the system at a transverse vibration frequency, wherein the mass oscillator comprises a housing, wherein the housing of the mass oscillator is connected with the drive shaft and with the drill bit so that driving the drilling motor causes the drive shaft, the housing of the mass oscillator and the drill bit to rotate at a rotation frequency of the drill bit, wherein the mass oscillator comprises at least one rotatable turbine and at least one eccentric mass rotatably connected with the turbine, wherein the turbine is driven by a fluid which is passed through the turbine; and (v) a bypass valve, wherein the bypass valve is actuated cyclically to vary a fluid flow rate through the turbine so that the transverse vibration frequency of the mass oscillator cyclically sweeps through a vibration frequency range which extends between a lower frequency limit and an upper frequency limit; and (b) a pipe string connected with the drilling apparatus.

21. The system as claimed in claim 20 wherein a desired vibration frequency is included within the vibration frequency range.

22. The system as claimed in claim 21 wherein the desired vibration frequency is a resonant mode frequency.

23. The system as claimed in claim 22 wherein the desired vibration frequency is about 50 Hz.

24. The system as claimed in claim 20 wherein the bypass valve has a valve cycling frequency and wherein the valve cycling frequency is less than the lower frequency limit.

25. The system as claimed in claim 24 wherein the bypass valve is actuated cyclically in a non-symmetrical manner.

26. The system as claimed in claim 20, further comprising a tuning mechanism for tuning the vibration frequency range of the mass oscillator, wherein the tuning mechanism is comprised of the bypass valve.

27. The system as claimed in claim 26, wherein the tuning mechanism tunes the vibration frequency range of the mass oscillator automatically.

28. A method for providing a transverse vibratory force to a system comprising a drilling apparatus and a pipe string, comprising:

(a) providing the drilling apparatus comprising:

(i) a drill bit;

(ii) a downhole drilling motor comprising a rotor and a stator;

(iii) a drive shaft connected with the rotor;

(iv) a mass oscillator for imposing transverse vibrations upon the system at a transverse vibration frequency, wherein the mass oscillator comprises a housing, wherein the housing of the mass oscillator is connected with the drive shaft and with the drill bit so that driving the drilling motor causes the drive shaft, the housing of the mass oscillator and the drill bit to rotate at a rotation frequency of the drill bit, wherein the mass oscillator comprises at least one rotatable turbine and at least one eccentric mass rotatably connected with the turbine, wherein the turbine is driven by a fluid which is passed through the turbine; and (v) a bypass valve for varying a fluid flow rate through the turbine;

(b) providing the pipe string;

(c) connecting the pipe string with the drilling apparatus; and (d) actuating the bypass valve cyclically to vary a fluid flow rate through the turbine so that the transverse vibration frequency of the mass oscillator cyclically sweeps through a vibration frequency range which extends between a lower frequency limit and an upper frequency limit.

29. The method as claimed in claim 28 wherein a desired vibration frequency is included within the vibration frequency range.

30. The method as claimed in claim 29 wherein the desired vibration frequency is a resonant mode frequency.

31. The method as claimed in claim 30 wherein the desired vibration frequency is about 50 Hz.

32. The method as claimed in claim 28 wherein the bypass valve has a valve cycling frequency and wherein the valve cycling frequency is less than the lower frequency limit.

33. The method as claimed in claim 32 wherein the bypass valve is ac cyclically in a non-symmetrical manner.

34. The method as claimed in claim 28, further comprising tuning the vibration frequency range of the mass oscillator.

35. The method as claimed in claim 34, wherein the vibration frequency range of the mass oscillator is tuned automatically.

36. A drilling method as claimed in claim 13 wherein the nutation frequency is provided using the method as claimed in claim 28.

* * * * *